US006018820A

United States Patent [19]

Lehman

[11] Patent Number: 6,018,820

[45] Date of Patent: Feb. 1, 2000

[54] HINGING VEIL

[76] Inventor: Vivian Lehman, P.O. Box 629, Bedford, N.Y. 10506

[21] Appl. No.: 09/082,982

[22] Filed: May 21, 1998

[51] Int. Cl.[7] ..... A42B 5/00

[52] U.S. Cl. ..... 2/207

[58] Field of Search ..... 2/206, 207; D2/500, D2/865, 875

[56] References Cited

U.S. PATENT DOCUMENTS 1,261,073 4/1918 Van Raalte ..... 2/207
1,671,889 5/1928 Dorros ..... 2/207
3,602,919 9/1971 Piccione ..... 2/207
5,138,720 8/1992 Campbell ..... 2/207

*Primary Examiner*—John J. Calvert
*Assistant Examiner*—Katherine Moran

[57] ABSTRACT

The veil consists of two pieces: a body portion and a hinging portion. The body portion frames the face and covers a substantial portion of the head. The two pieces of the veil are attached at a central location of the body portion when worn which provides for ease of movement from a covered to uncovered state.

1 Claim, 1 Drawing Sheet

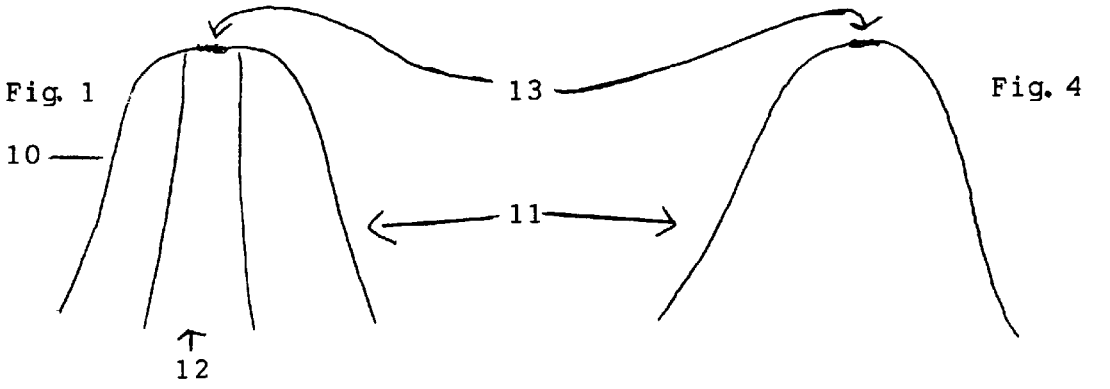
Fig. 1
10
13
11
12
Fig. 4
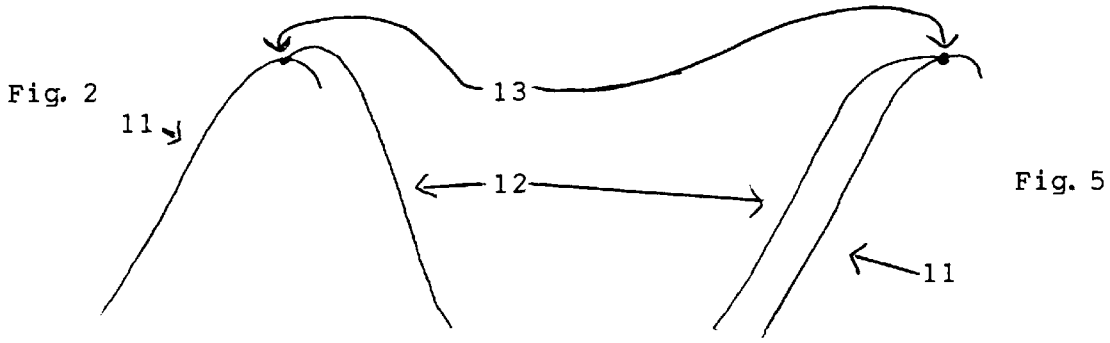
Fig. 2
11
13
12
Fig. 5
11
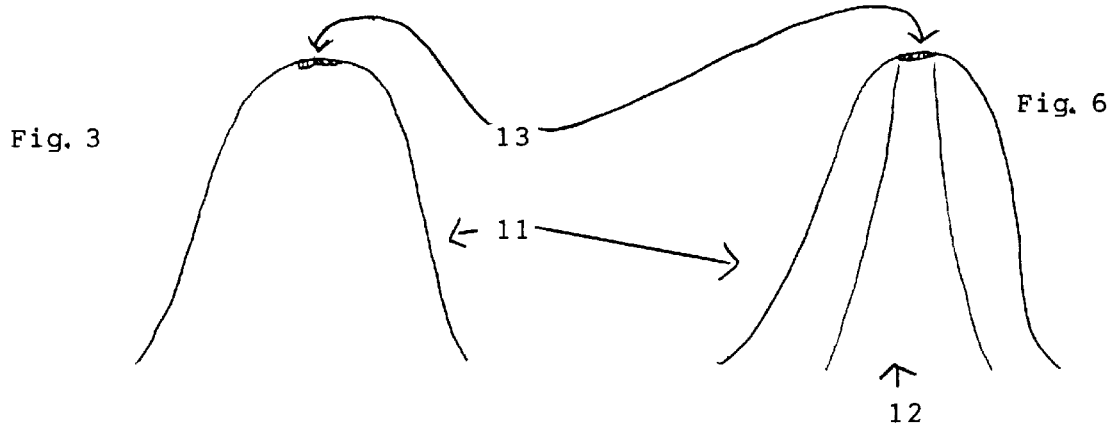
Fig. 3
13
11
Fig. 6
12

HINGING VEIL

SUMMARY OF INVENTION

The veil of the present invention is made up of a body portion and a hinging portion. The body portion covers the top, sides, back, and forehead regions of the head, forming a border around the face. The use of barrettes or other hair accessories may be necessary for stationing of the veil. The size of the body portion helps to conceal any hair accessories used to secure the veil from view. For construction of the veil, the hinging or lifting piece is initially separate from the back piece. The hinging piece is then stitched to the body portion at a central point of the head. The stitching forms a hinge structure so as to allow the hinging piece to move from a covering position to an uncovered position.

BRIEF DESCRIPTION OF THE DRAWINGS

FIG. 1 is a front view of the veil before the hinging portion is lifted back upon the body portion;

FIG. 2 is a side elevation view thereof;

FIG. 3 is a back view thereof;

FIG. 4 is a front view of the veil after the hinging portion is lifted back upon the body portion;

FIG. 5 is a side elevation view thereof,

FIG. 6 is a back view thereof.

DETAILED DESCRIPTION OF THE DRAWING (BEST MODE FOR CARRYING OUT THE INVENTION)

A preferred embodiment of the present veil is illustrated in FIGS. 1–6. The veil is used primarily for decorative purposes during ceremonial activities. FIGS. 1–6 illustrate veil 10 which has a body portion 11, a hinging portion 12, and stitching 13. The veil is shown from three different viewpoints, and shows the hinging portion 12 in a "before" position when it is pulled over the face, and in an "after" position when the hinging portion 12 is pulled back upon the body portion 11. The body portion 11 and hinging portion 12 are both unitary pieces of material. The hinging portion 12 is initially separate from the body portion 11. The veil is formed by stitching the hinging portion 12 to the body portion 11 at a location on the body portion 11 which is generally centrally located on the head of the wearer. When the hinging portion 12 is pulled back upon the body portion 11, the edges of the body portion 11 serve to frame the face. Depending upon the preference of the wearer, the hinging piece 12 may lie in two positions: forward over the face, or lifted back over the body portion 11.

I claim:

1. A veil comprising a body portion and a hinging portion, the hinging portion having top and bottom sides and opposite ends, wherein the body portion is configured to cover the top, back, and sides of a wearer's head and to frame the face, one end of the hinging portion is permanently attached to the body portion at a substantially central location on the body portion when the body portion is on the head; the hinging portion is liftable upon the body portion to a backward position uncovering the face and the hinging portion is placeable in front of the face to cover the framed opening.

* * * * *